US010076184B2

(12) United States Patent
Gauger et al.

(10) Patent No.: US 10,076,184 B2
(45) Date of Patent: Sep. 18, 2018

(54) FRAME FURNITURE

(71) Applicant: Jakob Gauger Sohne, Stuhl- und Tischfabrik, Innenausbau GmbH & Co., Mossingen (DE)

(72) Inventors: Bernd Gauger, Ofterdingen (DE); Martin Ballendat, Braunau am Inn (AT)

(73) Assignee: Jakob Gauger Sohne, Stuhl- und Tischfabrik, Innenausbau GmbH & Co., Mossingen (DE)

( * ) Notice: Subject to any disclaimer, the term of this patent is extended or adjusted under 35 U.S.C. 154(b) by 0 days.

(21) Appl. No.: 15/505,754

(22) PCT Filed: Aug. 11, 2015

(86) PCT No.: PCT/EP2015/068469
§ 371 (c)(1),
(2) Date: Feb. 22, 2017

(87) PCT Pub. No.: WO2016/030182
PCT Pub. Date: Mar. 3, 2016

(65) Prior Publication Data

US 2017/0295919 A1 Oct. 19, 2017

(30) Foreign Application Priority Data

Aug. 26, 2014 (DE) ..... 10 2014 112 231

(51) Int. Cl.
*A47B 7/02* (2006.01)
*A47B 3/08* (2006.01)
*A47B 3/02* (2006.01)

(52) U.S. Cl.
CPC ..... *A47B 7/02* (2013.01); *A47B 3/02* (2013.01); *A47B 3/0803* (2013.01); *A47B 2003/025* (2013.01); *A47B 2200/005* (2013.01)

(58) Field of Classification Search
CPC ... A47B 3/02; A47B 3/0803; A47B 2003/025; A47B 7/02; A47B 2200/005; A47B 21/00
See application file for complete search history.

(56) References Cited

U.S. PATENT DOCUMENTS 2,871,073 A * 1/1959 Swanson ..... A47B 7/02 108/64
3,408,965 A * 11/1968 Schroer ..... A47B 7/02 108/180

(Continued)

FOREIGN PATENT DOCUMENTS

DE 20102301 U1 10/2001
EP 199007 A2 10/1986
WO WO2012054799 A1 4/2012

*Primary Examiner* — Hanh V Tran
(74) *Attorney, Agent, or Firm* — King & Schickli, PLLC

(57) ABSTRACT

The invention relates to a frame furniture comprising a furniture plate (2) and two leg elements (4) supporting the furniture plate (2), said leg elements (4) being arranged on both sides of a vertical furniture median plane and being movably mounted. The frame furniture is characterized in that each leg element (4) can be moved between a normal position, in which the leg elements (4) are covered by the furniture plate (2), and an extended position, in which the leg elements (4) are uncovered at the top, in order to enable a stacking of the frame furniture via the leg elements (4).

12 Claims, 7 Drawing Sheets

(56) References Cited

U.S. PATENT DOCUMENTS

| | | | | | |
|---|---|---|---|---|---|
| 3,695,693 | A * | 10/1972 | Acton | A47C 3/04 | 297/239 |
| 3,742,869 | A * | 7/1973 | Polsky | A47B 7/02 | 108/64 |
| 4,779,541 | A * | 10/1988 | Milward | A47B 7/02 | 108/53.1 |
| 6,352,307 | B1 * | 3/2002 | Engman | A61G 5/1059 | 297/284.1 |
| 6,588,863 | B1 * | 7/2003 | Yatchak | A47B 3/0803 | 108/147.11 |
| 2005/0284341 | A1 * | 12/2005 | Klassy | A47B 21/00 | 108/50.02 |
| 2007/0261609 | A1 | 11/2007 | Kumazawa | | |
| 2008/0105173 | A1 * | 5/2008 | Weber | A47B 3/00 | 108/150 |
| 2008/0295742 | A1 * | 12/2008 | Henriott | A47B 21/00 | 108/6 |
| 2011/0198902 | A1 * | 8/2011 | Renbarger | A47C 9/00 | 297/219.1 |
| 2012/0126596 | A1 * | 5/2012 | Olarte | A47C 3/04 | 297/239 |
| 2016/0198841 | A1 * | 7/2016 | Weiser | A47B 3/0803 | 108/122 |

* cited by examiner

FRAME FURNITURE

FIELD OF THE INVENTION

The invention relates to a frame furniture comprising the features of the generic term in claim 1.

BACKGROUND OF THE INVENTION

Such a frame furniture is known from practice and comprises a furniture plate and two leg elements supporting the furniture plate. The leg elements are either arranged on both sides of a vertical furniture median plane or on two opposite sides of the frame furniture, respectively. The leg elements are movably mounted. When stacking the frame furniture, the leg elements can be pivoted in order to contact the furniture plate underside.

However, a complex adjustment mechanism is required for pivoting the leg elements. Moreover, in order to pivot the leg elements of such a frame furniture, it must be tilted, which may require great physical effort and can also lead to either damage to the frame furniture or injury to the user, respectively.

SUMMARY OF THE INVENTION

The object of the invention therefore is to create a frame furniture as mentioned above which is characterized by a good stackability and in particular by a simple adjustment mechanism of the leg elements as well.

The object is inventively attained by the frame furniture comprising the features of claim 1.

The invention proposes a frame furniture comprising a furniture plate and two leg elements supporting the table top, said leg elements arranged on both sides of a vertical furniture median plane and movably mounted. The leg elements can each be moved between a normal position, in which the leg elements are covered by the furniture plate, and a pullout position, in which the leg elements are uncovered at the top, in order to enable a stacking of the frame furniture via the leg elements.

Thus, by means of a simple adjustment mechanism, frame furnitures of the same make can be stacked with minimum space requirements namely by pulling the leg elements out from underneath the furniture plate when either stacking the frame furniture or producing the pullout position of the leg elements. So during the pullout position, the leg elements are arranged beside the furniture plate and therefore run beside the furniture plates of frame furnitures stacked underneath. The inventive frame furniture are thereby easily stackable with little space requirements.

In a preferred embodiment of the frame furniture according to the invention, the leg elements are each arranged on a pullout carrier which is movable at a right angle to the furniture median plane. Hence, the leg elements can be moved guided between their normal position and the pullout position. Thus, a simple adjustment mechanism is realized, wherein the leg elements can essentially retain their orientation to the furniture plate when stacked with pieces of furniture of the same make.

In another preferred embodiment of the frame furniture according to the invention, the pullout carriers are guided along a support frame which is mounted to the furniture plate underside. The support frame consequently forms a base for the pullout carriers and can increase the stiffness of the furniture plate.

In another preferred embodiment of the frame furniture according to the invention, each leg element has an allocated clamping lever, which is movable between a releasing position in which the corresponding leg element is movable, and a locking position in which the corresponding leg element is clamped. The clamping lever can consequently determine the normal position and the locking position of the corresponding leg element and thus prevents an unintended budging of the corresponding leg elements.

In another preferred embodiment of the frame furniture according to the invention, the clamping lever is realized as an eccentric lever. An eccentric lever enables determining or releasing the locking position of the clamping lever with little physical effort.

In another preferred embodiment of the frame furniture according to the invention, the clamping lever engages in a clamping guide track of the pullout carrier, said clamping guide track featuring a clamping recess defining the pullout position and the normal position. The clamping guide track is consequently realized with two sections. It is also possible, however, to provide several stages or to realize the leg elements adjustable without any stages.

In another preferred embodiment of the frame furniture according to the invention, a leg element is formed by a tubular element curved in such a way that it forms a front furniture leg and a back furniture leg, wherein the tubular elements each comprise either an elliptic or oval cross-section comprising a long major axis and a short minor axis, wherein the major axis and the minor axis intersect the vertical furniture median plane over the length of the particular tubular element at an angle of less than 90°.

Thus, the core of this embodiment is defined in that the curved tubular elements have an elliptic or oval, i.e. not circular, cross-section and the curvature of the tubular elements occurs not via the major axis or minor axis of the ellipse formed by the cross-section of the tubular elements at the apex but instead occurs via an axis between the corresponding minor axis and the corresponding major axis. This axis is at least largely positioned in the transverse direction regarding the vertical median plane, whereas an axis positioned at a right angle to this axis lies on a plane which is spanned by the major axis of the corresponding tubular element. Thereby, a small stacking space between frame furnitures of the same make can be created. Simultaneously, the tubular elements act as a kind of cone which exactly aligns the frame furnitures to each other when stacked.

The term "elliptic" is to be understood in its broadest sense, i.e. not in a strictly mathematical sense. In fact, the term describes that the tubular element does not have a circular cross-section but a rather flattened round cross-section. The longest diameter is formed by the major axis whereas the smallest diameter is formed by the minor axis which is positioned at a right angle to the major axis.

In another preferred embodiment of the frame furniture according to the invention, the major axis points upward in the direction of the furniture median plane over the length of the corresponding tubular element and the minor axis points downward in direction of the furniture median plane over the length of the corresponding tubular element. The contact surface formed by the two leg elements when stacking the frame furniture point to the inside at the bottom of the tubular element, i.e. in direction of the median plane, and up, i.e. at its visible side, to the outside away from the median plane.

In regard to the stackability of the frame furniture, a major axis has proven to be especially suitable which intersects the vertical median plane at an angle between 30° and 60°.

In order to attain a mostly rattle-free storage of the frame furnitures when stacked, a stacking bumper can be provided which is expediently encompassed by the curved section forming a section of the corresponding tubular element which is between the two furniture legs of the corresponding leg element.

The stacking bumper can comprise a linking element which can link a frame furniture with another frame furniture of the same make.

In order to facilitate the stacking process, the furniture elements at each of their end sections can comprise a stacking guide which lies on the furniture leg of a frame furniture of the same make when stacked.

The frame furniture can be a table as well as a bench.

Further advantages and advantageous embodiments of the frame furniture according to the invention can be derived from the description, the drawing and the Claims.

BRIEF DESCRIPTION OF THE DRAWING FIGURES

Embodiments of a frame furniture according to the invention are shown in the drawing in a schematically simplified form and are further explained in the following description. In the figures FIG. 1 shows a partially perspective view of two tables according to the invention when stacked;

DETAILED DESCRIPTION OF THE INVENTION

Figure 1:
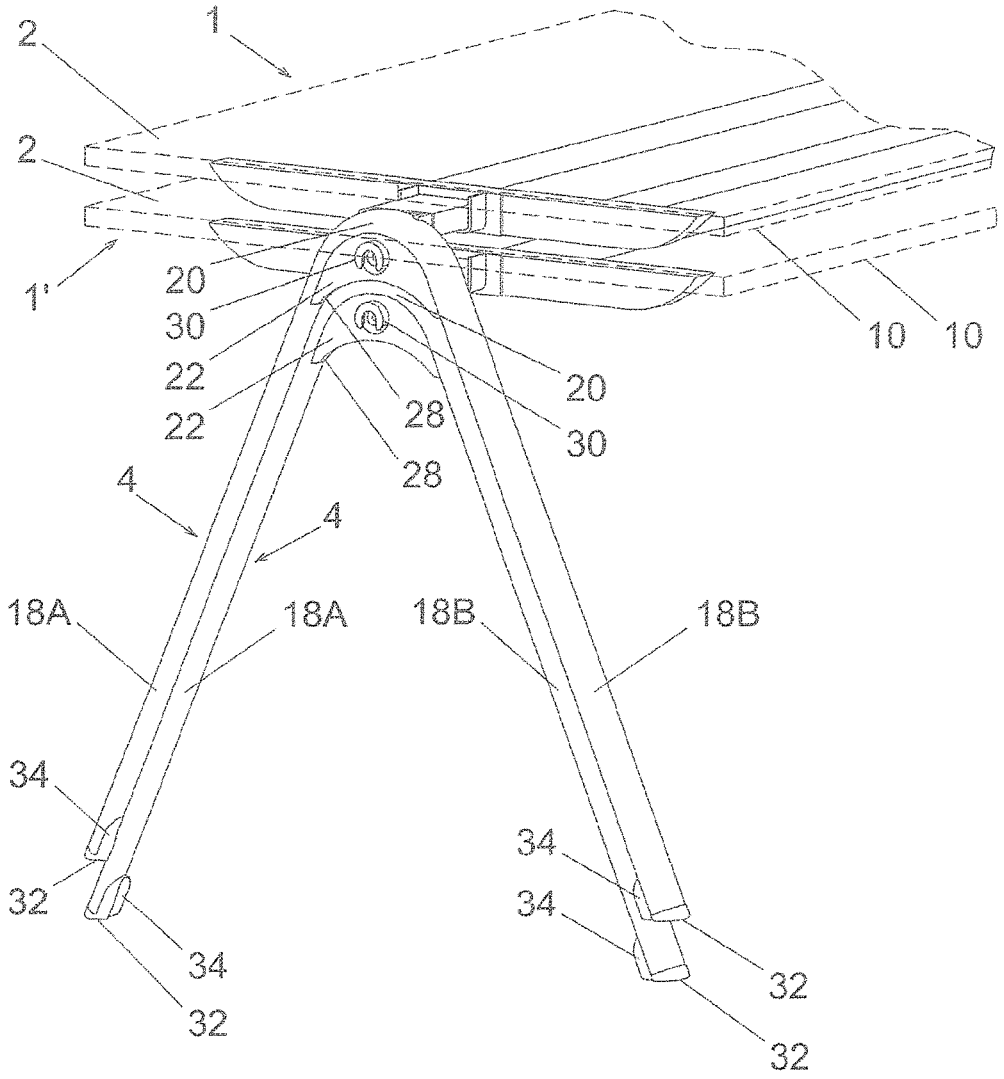

FIG. 1 shows two frame furnitures in an embodiment as tables, 1, 1' of the same make which are stacked and each comprise a furniture plate 2. The furniture plate 2 are each supported by leg elements 4 which are arranged on both sides of a vertical furniture median plane, i.e. a vertical table median plane, and of which only one is illustrated in the present case for clarity. The leg elements 4 are illustrated in the pullout position in FIG. 1 and consequently not covered by a furniture plate 2, meaning the leg elements 4 are uncovered at the top so that a stackability of the tables 1, 1' is possible via the leg elements.

A corresponding support frame 8 is mounted on the furniture plate underside 10 of the furniture plate 2, alongside said support frame 8, for each leg element 4, a pullout carrier 6 is guided which is movable perpendicularly to the table median plane. The corresponding leg element 4 is arranged along the pullout carrier 6, said leg element comprising a curved tube which forms a corresponding front furniture leg 18A and a corresponding rear furniture leg 18B. The furniture legs 18A, 18B are connected via an upper curved section 20 of the corresponding tubular element and diverge at the bottom, i.e. in direction of the floor area, in a V-shape, wherein parallel planes are spanned from the furniture legs 18A, 18B of the two leg elements 4 of a table 1, 1'.

The tubular elements, of which the furniture legs 18A, 18B are formed, each have an in the broadest sense elliptic cross-section with one long major axis and a short minor axis, as shown in FIGS. 3 to 6. Over the entire length of the corresponding tubular element, i.e. in the corresponding curved sections 20 as well, the long major axis of the ellipse formed by the cross-section points upward in the direction of the vertical table median plane, so that the two leg elements 4 form a stacking help in shape of a cone with a downward opening. Since the leg elements 4 on one of the table sides and the leg elements 4 on the other table side lie on top of each other, the tables stacked on top of each other are secured. Thus, the tubular elements are curved via an axis of the cross-section ellipse arranged in the apex, said axis lying between the corresponding major axis and the corresponding minor axis and preferably spanning an angle between 45° and 60° with the major axis.

The major axis of the elliptic tubular element cross-sections intersect the vertical table median plane in an angle of approximately 30° and 45° and does this over the entire length of the tubular elements.

The curved sections 20 of the leg element 4 each encompass a stacking bumper 22 which lies on a curved section 20 of the leg elements 4 of a table 1' positioned underneath with a contact surface 28. The contact surface 28 has a form which is fitted to the outer surface of the corresponding curved section 20. Furthermore, the stacking bumpers 22 each have a linking element on the sides averted from the table median plane which in this case is formed as a protrusion 30 on the side of the leg element 4 and as a recess on the side of the leg element 4 of a table 1, 1', fitting into the protrusion 30.

In the end area, the furniture legs 18A, 18B each comprise a foot insert 32 made of plastic in which a stacking guide 34 made in one piece with the foot insert 32 is aligned along the inside of the furniture leg. The stacking guides 34 lie on the outside of the corresponding furniture leg 18A, 18B when the tables 1, 1' are stacked.

Figure 2:
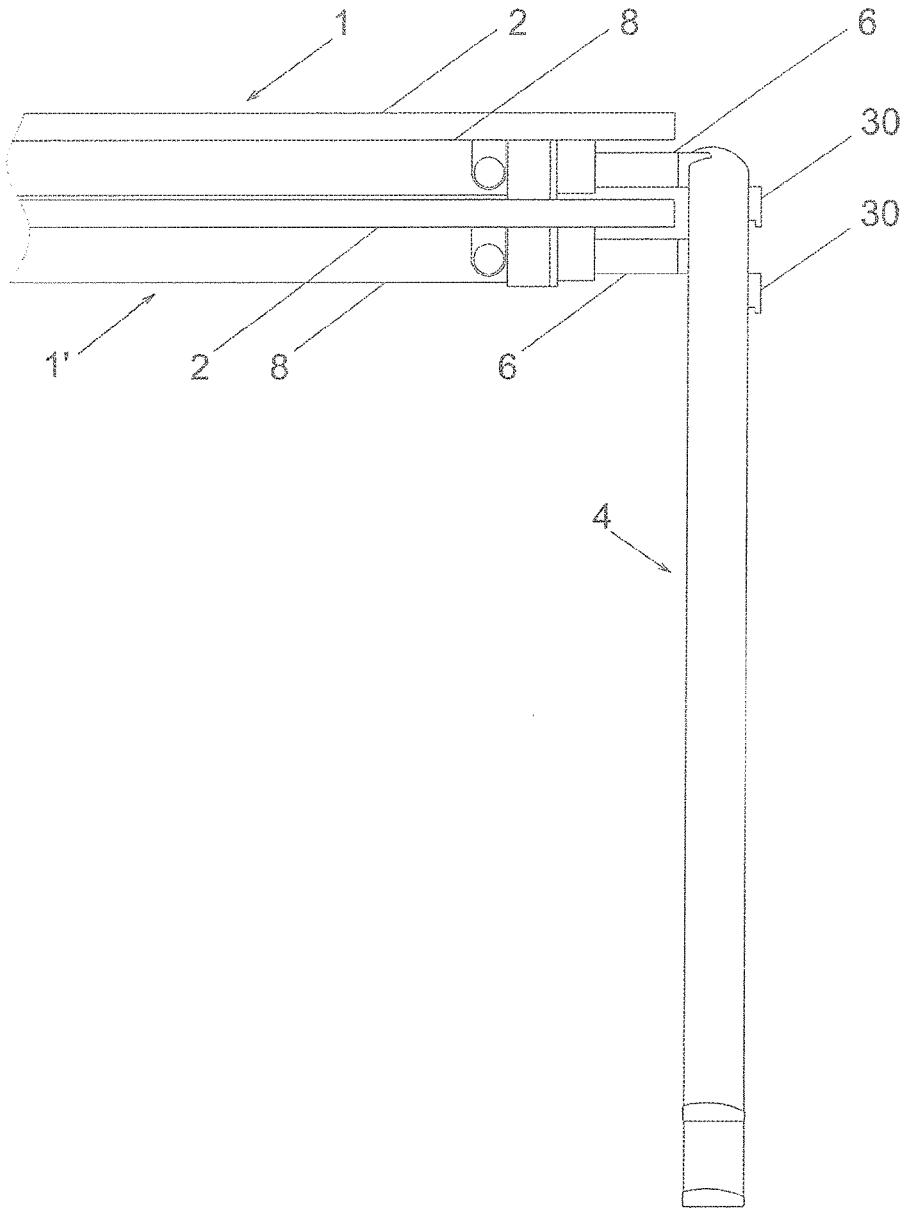
FIG. 2 shows a side view of the two stacked tables according to FIG. 1.

The uncovered leg elements 4 at the top of the stacked tables 1, 1' of the same make are illustrated in FIG. 2 in a side view. The leg elements 4 are illustrated in their pullout position and are displaced about 60 mm outward in relation to the vertical table median plane in contrast to their corresponding normal positions. The leg elements 4 of the upper table 1 therefore either run underneath the furniture plate 2 of table 1' or are arranged underneath beside the furniture plate 2 of the table 1', respectively, in order to overlap with the corresponding leg elements 4.

Figure 3:
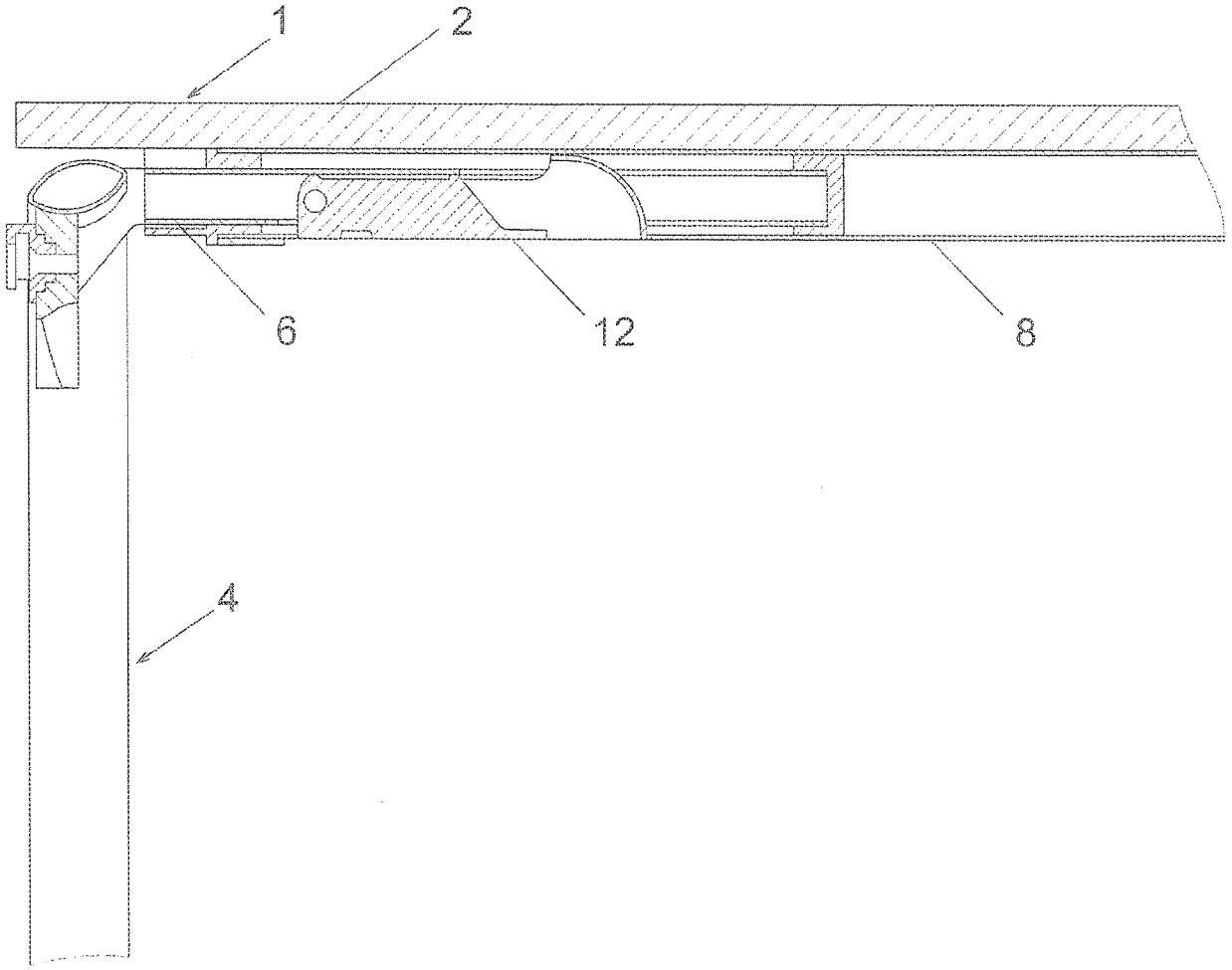
FIG. 3 shows a side view of a table with a leg element in normal position in a secure state.

FIG. 3 shows the leg element 4 in its normal position in which it is entirely covered by the furniture plate 2. The leg element 4 is covered by the furniture plate 2 in such a way that a largely continuous furniture top surface can be formed by linking another table of the same make via the protrusion 30 and the corresponding recess.

Figure 4:
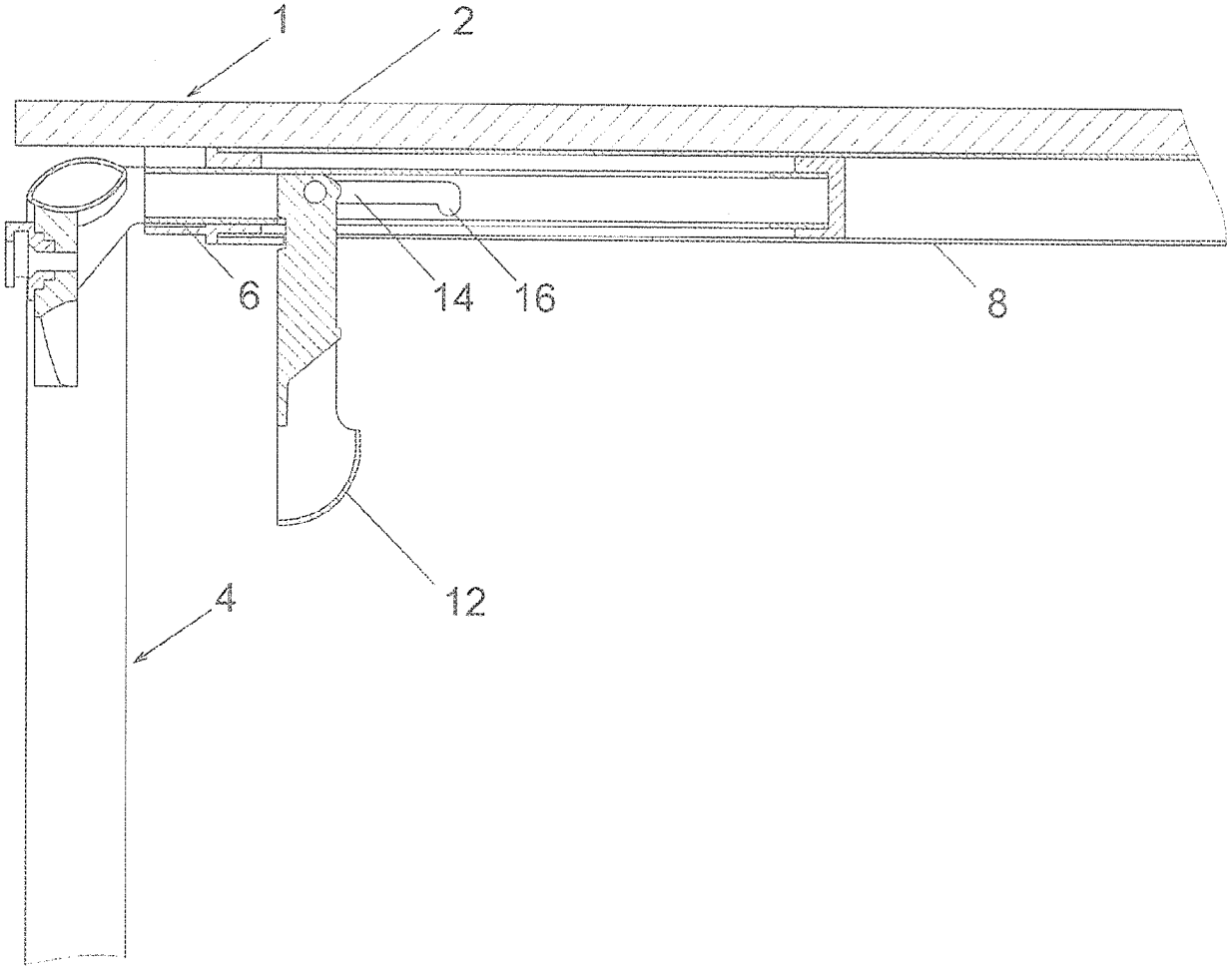
FIG. 4 shows a side view of a table with a leg element in normal position in an insecure state.
Figure 5:
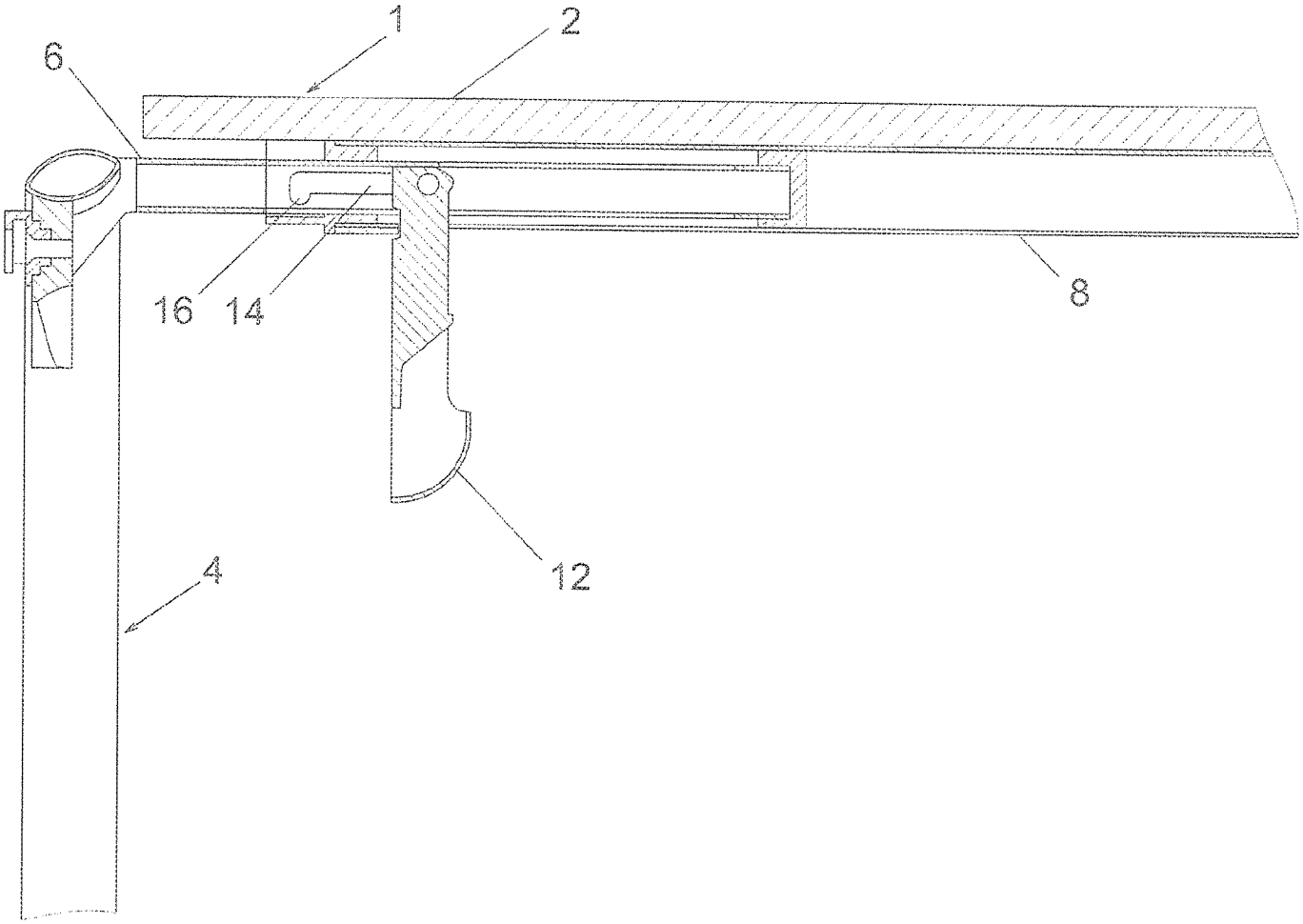
FIG. 5 shows a side view of the table with a leg element in pullout position in an insecure state.

For producing the pullout position of the leg element 4, a clamping lever 12 is pivoted in its releasing position, as shown in FIG. 4. The clamping lever 12 is realized as an eccentric lever and engages in a clamping guide track 14 of the pullout carrier 6. The clamping guide track 14 of the pullout carrier 6 comprises a clamping recess defining to the pullout position and the normal position, respectively, wherein FIG. 4 only shows the clamping recess 16 defining the normal position. As soon as the pullout carrier 6 is either released or no longer clamped, respectively, it can be moved together with the leg element 4, wherein the distance is defined by the length of the clamping guide track 14. Thus, the pullout position and the stacking position of the leg element can be determined (cf. FIG. 5).

Figure 6:
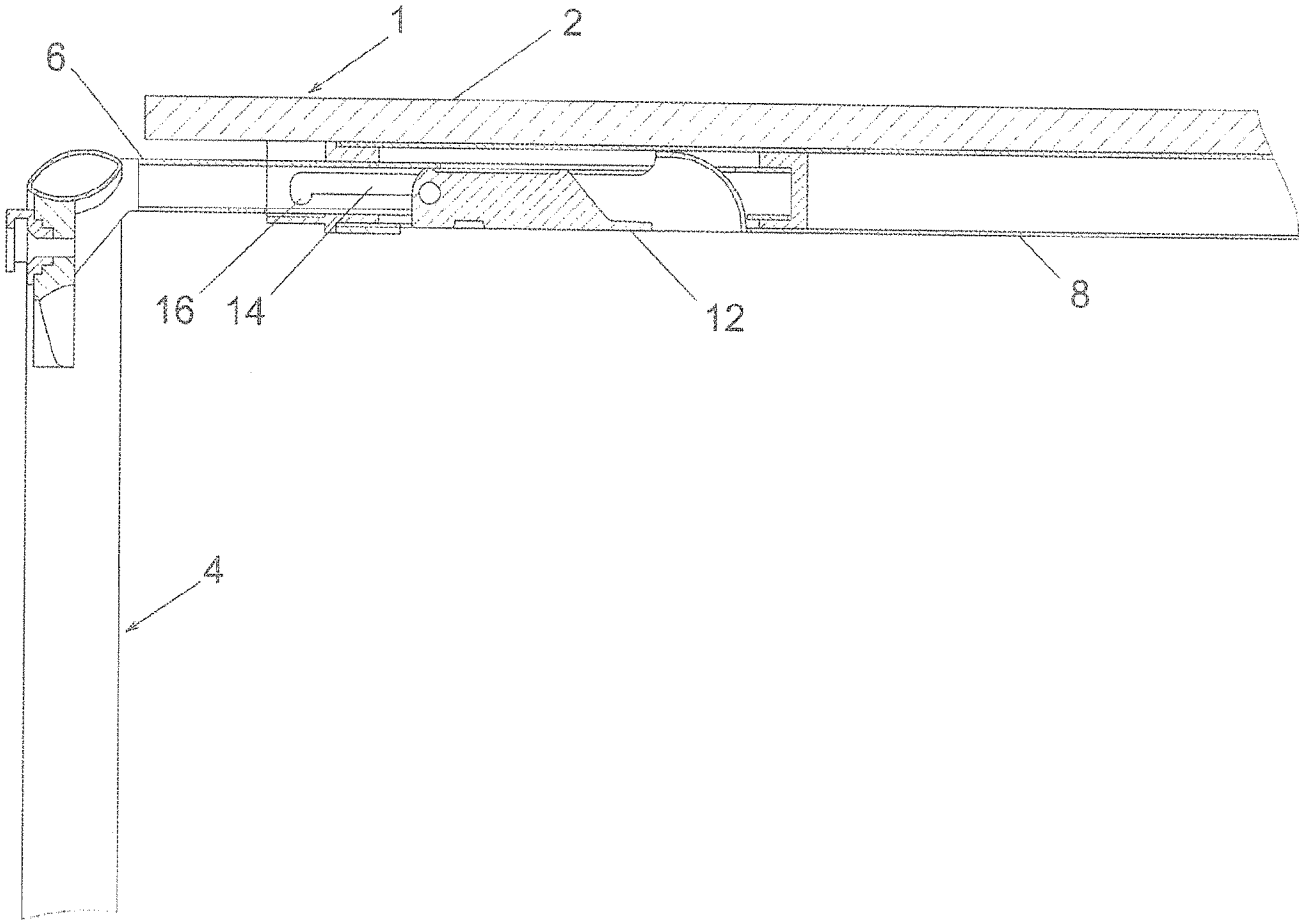
FIG. 6 shows a side view of the table with a leg element in pullout position in a secure state.

For securing the pullout position, the clamping lever 12 can be pivoted towards the furniture plate 2 when in its locking position, in order to determine the normal position or pullout position of the corresponding leg element 4 with the corresponding clamping recess 16 (cf. FIG. 6). Thereby the clamping lever 12 engages in the corresponding clamping recess 16 and clamps the pullout carrier 6 and thus the leg element 4, wherein the leg element 4 is secured from unintended budging.

The adjustment of the leg element 4 from the pullout position or the stacking position, respectively, to the normal position takes place in reversed order.

Figure 7:
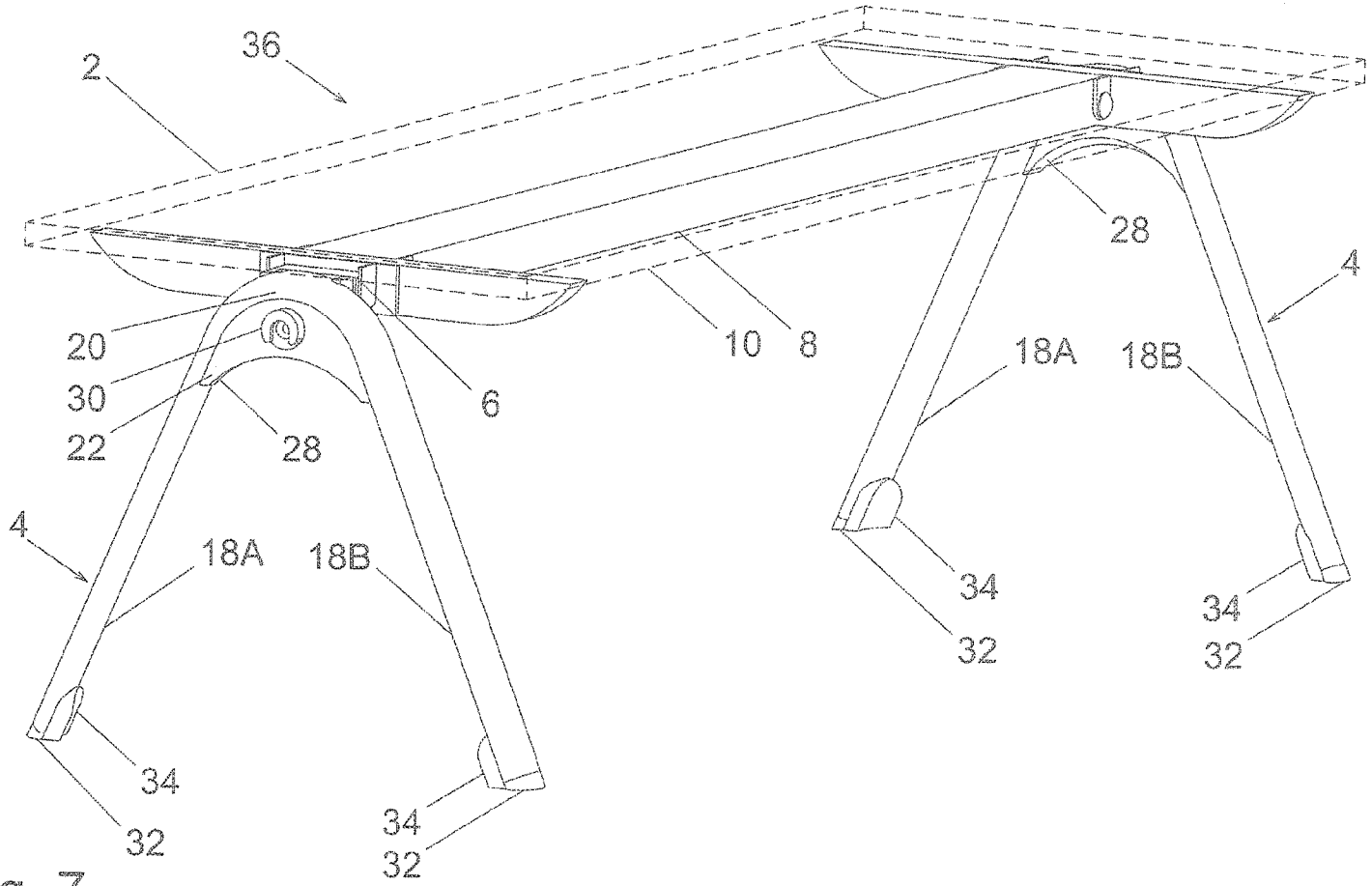
FIG. 7 shows a perspective view of the bench according to the invention.

The bench 36 illustrated in FIG. 7 comprises a furniture plate 2 which is supported by leg elements 4 are arranged on both sides of a vertical furniture median plane, i.e. of a vertical bench median plane. The leg elements 4 of the bench 36 are realized shorter than the leg elements 4 of table 1, 1'. The leg elements 4 illustrated in FIG. 7 are in normal position and consequently covered by the furniture plate 2, meaning the leg elements 4 are covered at the top so that a stacking of the bench 36 is not possible via the leg elements. The leg elements 4 are thereby covered by the furniture plate 2 in such a way that a largely continuous furniture top surface, i.e. a seating surface, can be formed by linking with another bench of the same make via the protrusion 30 and the corresponding recess.

A corresponding support frame 8 is mounted on the furniture plate underside 10 of the furniture plate 2, alongside said support frame 8, for each leg element 4, a pullout carrier 6 is guided which is movable perpendicularly to the bench median plane. The corresponding leg element 4 is arranged along the pullout carrier 6, said leg element comprising a curved tube which forms a corresponding front furniture leg 18A and a corresponding rear furniture leg 18B. The furniture legs 18A, 18B are connected via an upper curved section 20 of the corresponding tubular element and diverge at the bottom, i.e. in direction of the floor area, in a V-shape, wherein parallel planes are spanned from the furniture legs 18A, 18B of the two leg elements 4 of the bench 36.

The tubular elements, of which the furniture legs 18A, 18B are formed, each have an in the broadest sense elliptic cross-section with one long major axis and a short minor axis, as shown in detail in FIGS. 3 to 6 in correlation with a table 1, 1'. Over the entire length of the corresponding tubular element, i.e. in the corresponding curved sections 20 as well, the long major axis of the ellipse formed by the cross-section points upward in the direction of the vertical table median plane, so that the two leg elements 4 form a stacking help in shape of a cone with a downward opening. Since the leg elements 4 on one of the bench sides and the leg elements 4 on the other bench side lie on top of each other, the benches stacked on top of each other are secured. Thus, the tubular elements are curved via an axis of the cross-section ellipse arranged in the apex, said axis lying between the corresponding major axis and the corresponding minor axis and spanning an angle of preferably 45° and 60° with the major axis.

The major axis of the elliptic tubular element cross-sections intersect the vertical bench median plane in an angle of approximately 30° and 45° and does this over the entire length of the tubular elements.

The curved sections 20 of the leg element 4 each encompass a stacking bumper 22 which lies on a curved section 20 of the leg elements 4 of a bench positioned underneath with a contact surface 28. The contact surface 28 has a form which is fitted to the outer surface of the corresponding curved section 20. Furthermore, the stacking bumpers 22 each have a linking element on the sides averted from the bench median plane which in this case is formed as a protrusion 30 on the side of the leg element 4 of the bench 36, said leg shown in the foreground of the drawing, and as a recess on the side of the leg element 4 of the bench 36, fitting into the corresponding protrusion 30.

In the end area, the furniture legs 18A, 18B each comprise a foot insert 32 made of plastic in which a stacking guide 34 made in one piece with the foot insert 32 is aligned along the inside of the respective furniture leg. The stacking guides 34 lie on the outside of the corresponding furniture leg 18A, 18B when the bench 36 is stacked.

The adjustment mechanism described in correlation with the table 1, 1', comprising the clamping lever 12, the clamping guide track 14 and the clamping recess 16, is realized analogously to table 1, 1' with the bench 36 illustrated in FIG. 7 as well.

In reference to the table 1 illustrated in FIGS. 4 and 6 and the reference signs used for the table 1, the adjustment of a leg element 4 of a bench 36 is described. For producing the pullout position of the leg element 4 of a bench 36, a clamping lever 12 is pivoted in its releasing position away from the furniture plate 2, as shown in FIG. 4 in correlation with table 1, 1'. The clamping lever 12 is realized as an eccentric lever and engages in a clamping guide track 14 of the pullout carrier 6. The clamping guide track 14 of the pullout carrier 6 comprises a clamping recess defining the pullout position and the normal position, respectively, wherein FIG. 4 only shows the clamping recess 16 defining the normal position. As soon as the pullout carrier 6 is either released or no longer clamped, respectively, it can be moved together with the leg element 4, wherein the distance is defined by the length of the clamping guide track 14 and can be 60 mm. Thus, the pullout position and the stacking position of the leg element can be determined.

For securing the pullout position, the clamping lever 12 can be pivoted towards the furniture plate 2 when in its locking position, in order to determine the normal position or pullout position of the corresponding leg element 4 with the corresponding clamping recess 16 (cf. FIG. 6). Thereby, the clamping lever 12 engages in the corresponding clamping recess 16 and clamps the pullout carrier 6 and thus the leg element 4, wherein the leg element 4 is secured against unintended moving.

The adjustment of the leg element 4 from the pullout position or the stacking position, respectively, to the normal position takes place in reversed order.

The invention claimed is:

1. A frame furniture comprising a furniture plate (2) and two leg elements (4) supporting the furniture plate (2), said leg elements (4) being arranged on both sides of a vertical furniture median plane and being movably mounted, wherein the leg elements (4) can be moved between a normal position, in which the leg elements (4) are covered by the furniture plate (2), and a pullout position, in which the leg elements (4) are uncovered at the top, in order to enable a stacking of the frame furniture via the leg elements (4), characterized in that one of said leg elements (4) is formed by a tubular element curved in such a way that it forms a front furniture leg (18A) and a back furniture leg (18B), wherein the tubular element comprises either an elliptic or an oval cross-section comprising a long major axis and a short minor axis, wherein the major axis and the minor axis intersect the vertical furniture median plane over the length of the particular tubular element at an angle of less than 90°.

2. The frame furniture according to claim 1, characterized in that the leg elements (4) are each arranged on a pullout carrier (6) which is movable perpendicular to the furniture median plane.

3. The frame furniture according to claim 2, characterized in that the pullout carrier (6) is guided along a support frame (8) which is mounted to the furniture plate underside (10).

4. The frame furniture according to claim 1, characterized in that each leg element (4) has an allocated clamping lever (12), which is movable between a releasing position in which the corresponding leg element (4) is movable between a normal position and a pullout position, and a locking position in which the corresponding leg elements (4) are clamped.

5. The frame furniture according to claim 4, characterized in that the clamping lever (12) is realized as an eccentric lever.

6. The frame furniture according to claim 4, characterized in that the clamping lever (12) engages with a clamping guide track (14) of the pullout carrier (6), said clamping guide track (14) comprising a clamping recess (16) defining the pullout position and the normal position.

7. The frame furniture according to claim 1, characterized in that the major axis points upward towards the furniture median plane over the length of the corresponding tubular element and that the minor axis points downward in direction of the furniture median plane.

8. The frame furniture according to claim 1, characterized in that a main axis intersects the vertical furniture median plane at an angle between 30° and 60°.

9. The frame furniture according to claim 1, characterized in that a curved section (20) of the corresponding tubular element lies between the furniture legs (18A, 18B) of the corresponding tubular element, said encompassing a stacking bumper (20).

10. The frame furniture according to claim 9, characterized in that the stacking bumper (22) forms a linking element by which the frame furniture can be linked with another frame furniture of the same make.

11. The frame furniture according to claim 1, characterized in that the furniture legs (18A, 18B) each comprise a stacking guide (34) at their end sections, said stacking guides (34) abutting to the furniture leg (18A, 18B) of a frame furniture of the same make when stacked.

12. The frame furniture according to claim 1, characterized in that it is a table (1', 1) or a bench (36).

* * * * *